United States Patent [19]

Karterman

[11] Patent Number: 4,579,281

[45] Date of Patent: Apr. 1, 1986

[54] AMUSEMENT DRINKING DEVICE

[76] Inventor: Don S. Karterman, 675 Birch St., Anchorage, Ak. 99501

[21] Appl. No.: 714,821

[22] Filed: Mar. 22, 1985

[51] Int. Cl.[4] ..... A47G 21/18

[52] U.S. Cl. ..... 239/33; 446/200; 446/201

[58] Field of Search ..... 239/33, 240; 446/200, 446/201, 202, 217, 218; 415/170 R, 172 R, 213 R, DIG. 7

[56] References Cited

U.S. PATENT DOCUMENTS 478,861 7/1892 Howard ..... 239/33

2,932,457 4/1960 Ballard ..... 239/240 X 3,315,405 4/1967 Hoffer ..... 239/33 X 4,252,273 2/1981 Karterman ..... 239/33

FOREIGN PATENT DOCUMENTS 481169 2/1952 Canada ..... 446/200

*Primary Examiner*—Andres Kashnikow

*Attorney, Agent, or Firm*—Warren F. B. Lindsley

[57] ABSTRACT

A drinking device adapted for interposition between two drinking straws. An impeller mounted inside the device is rotated by fluid drawn through the device by the user, the impeller turning an external vane for the amusement of the user.

10 Claims, 7 Drawing Figures

FIG. 1
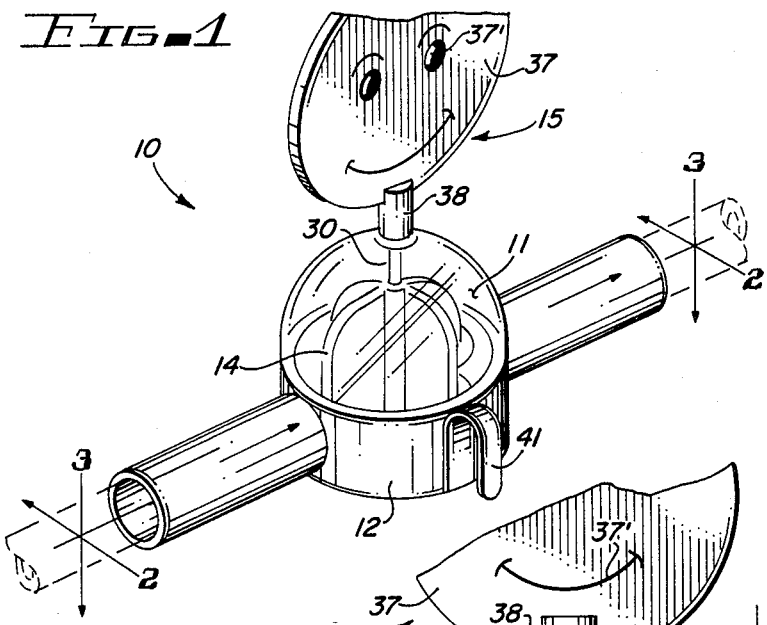
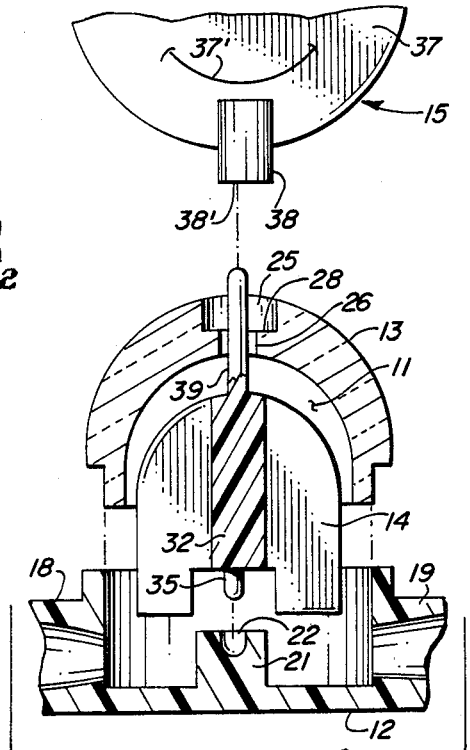
FIG. 4
FIG. 2
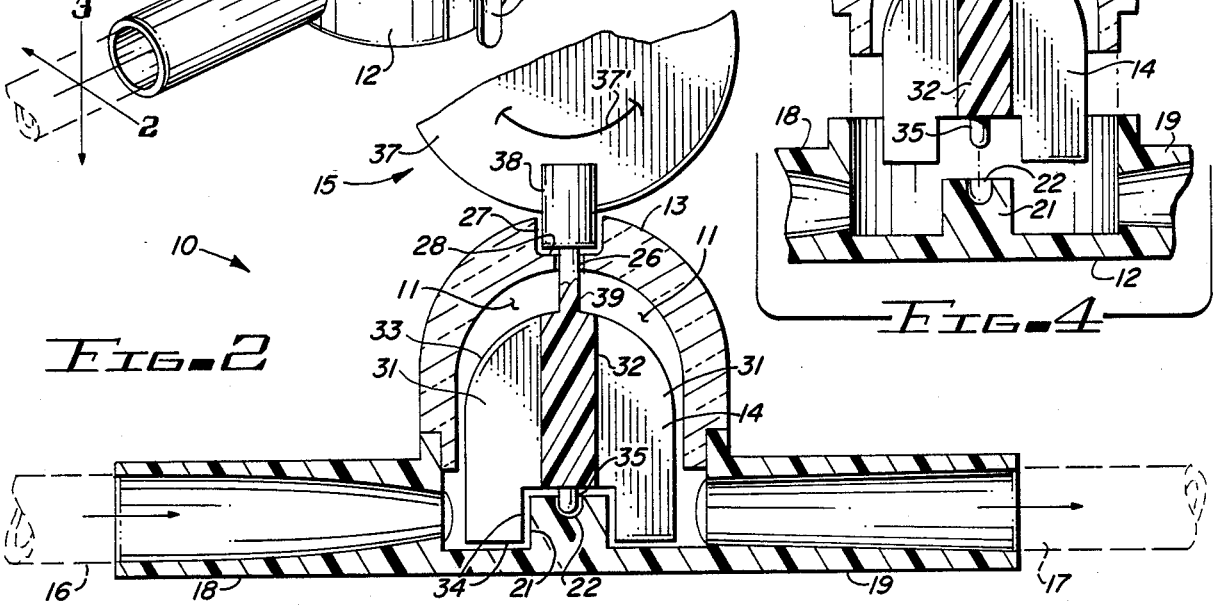
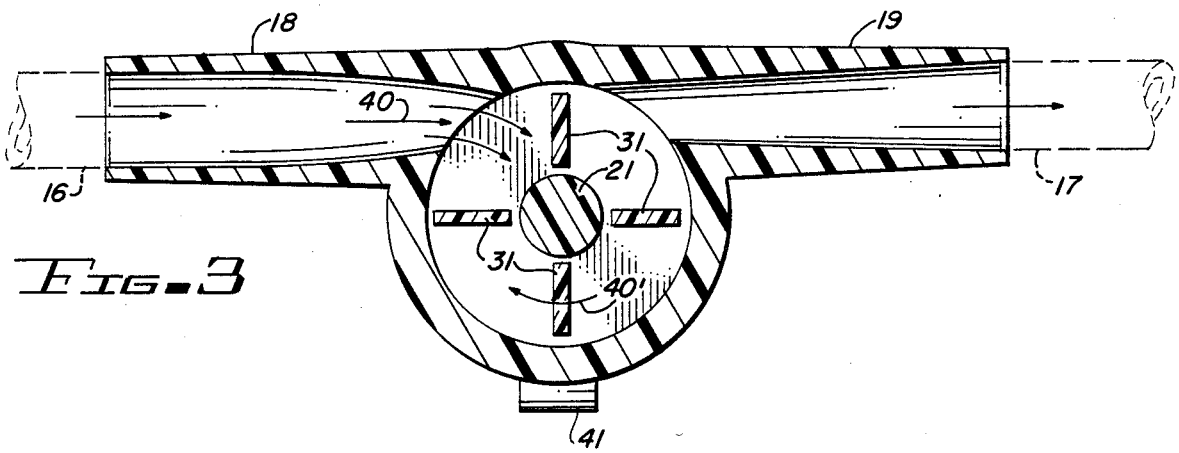
FIG. 3

AMUSEMENT DRINKING DEVICE

BACKGROUND OF THE INVENTION

This invention relates to a drinking device, particularly for children, which is adapted to be amusing to the user. In addition to the amusement it offers, the device has utility as a means for encouraging children to drink nourishing fluids.

The drinking device comprises a chamber that is interposed between two segments of a drinking straw. An impeller mounted in the chamber is rotated by the flow of the fluid that is drawn through the straw and is coupled to a decorative spinner outside of the chamber that is rotated thereby for the amusement of the user of the device.

DESCRIPTION OF THE PRIOR ART

Earlier versions of this device are disclosed in U.S. Pat. No. 4,252,273, the disclosure of which is incorporated herein by reference. While these earlier versions provide the desired function, they can be improved to provide better bearing structures and to eliminate cavitation and the resulting reduction in the suction effect created by the user.

In one embodiment of an earlier version of the invention, a rotating shaft was passed through an aperture in the housing to engage with an exposed decorated vane. The external rotating vane was particularly effective as a focal point for entertainment, but the aperture for the bearing shaft was found to admit excessive air into the housing of the device and the entrained air interfered with the operation of the device.

Other deficiencies in the designs of the earlier devices interfered with its mechanical function. Relatively large cross-sectional flow areas in the region of the impellers resulted in low fluid velocities and hence relatively slow rotation of the impeller. Impeller and impeller chamber designs were inefficient because they failed to eliminate fluid masses that were circulated in the housing as dead weight by the impeller during its rotation.

Another problem associated with the earlier device was that its relatively fragile construction was thought to render it unsafe for use by children. It was feared that parts or elements of the device might break away and be swallowed by the user.

Improvements are needed to provide a fully effective and acceptable amusement drinking device.

SUMMARY OF THE INVENTION

In accordance with the invention claimed, an improved amusement drinking device is provided particularly for use by children. The improved device offers enhanced mechanical efficiency and functionality in a construction that is free of any serious safety hazards.

It is, therefore, an object of this invention to provide a new and improved amusement drinking device incorporating rotating elements.

Another object of the invention is to provide a new and improved mechanically efficient drinking device employing a rotating impeller that is actuated through a minimum of effort on the part of the user.

A further object of this invention is to provide a new and improved drinking device employing an impeller that achieves mechanical efficiency through improved techniques related to fluid flow.

A still further object of this invention is to provide an improved amusement drinking device employing a rotating impeller within a housing that is connected to an external rotating member outside of the housing that effectively prevents cavitation of air into the housing to interfere with the mechanical functioning and efficiency of the device.

A still further object of the invention is to provide in such a device a more efficient impeller design.

A still further object of the invention is to provide in such a device an improved rotational mounting means for the impeller.

Yet another object of the invention is to provide such an amusement drinking device in a sturdy and nonhazardous form that will be found safe for use by children.

These and other objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which:

FIG. 1 is a perspective view of the invention showing a first embodiment of an amusement drinking device;

FIG. 2 is a partial cross-sectional view of FIG. 1 as seen along the line 2—2;

FIG. 3 is a partial cross-sectional view of FIG. 1 as seen along the line 3—3;

FIG. 4 is a second cross-sectional view of FIG. 1 again as seen along line 3—3, but with the device partially disassembled;

DESCRIPTION OF THE PREFERRED EMBODIMENT

Figure 5:
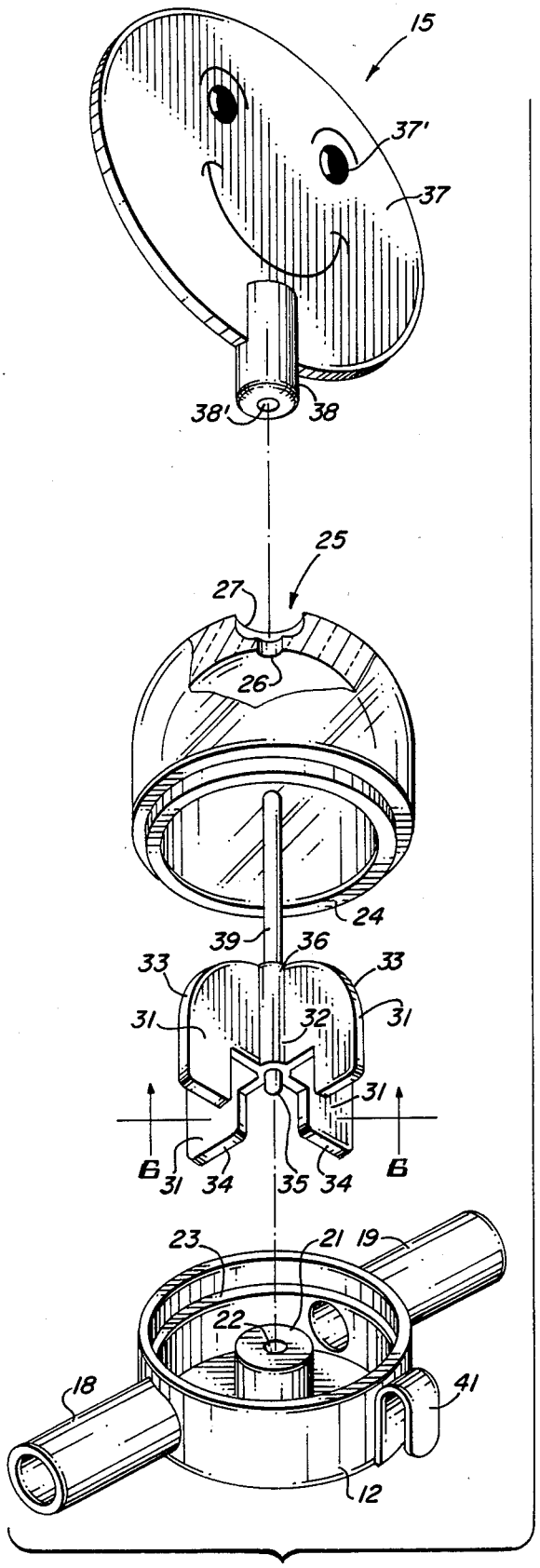
FIG. 5 is an exploded perspective view of FIG. 1 showing the elements in an exploded view.

Referring more particularly to the drawings by characters of reference, FIGS. 1–6 disclose a new and improved amusement drinking device 10 comprising an impeller chamber 11 having a base 12 and dome 13, an impeller 14 and a rotor disc or spinner 15. This device is intended to be interposed between two straws or two segments 16 and 17 of a drinking straw which are inserted one in each of the inlet and outlet bushings 18 and 19, respectively, of base 12.

Base 12, as shown more clearly in FIG. 5, comprises a low profile cup having a flat bottom with the hollow bushings 18 and 19 opening into base 12 along an axis laterally of and spaced from the longitudinal axis of base 12. The interior of bushing 18 through which fluid enters base 12 is tapered toward chamber 11 to form a reduced cross-section at the point of its entry into chamber 11 which is smaller than the cross-section of bushing 19 at any point along its length. Extending upwardly from the center of base 12 in the direction of its longitudinal axis is a short cylindrical post 21 having a notch or cylindrical depression 22 in its exposed end which serves as a shaft retainer. Encircling the rim of base 12 as shown in FIG. 5 is an inner peripheral rabbet 23.

Dome 13 is a hollow configuration approximately hemispherical in shape having its lower open end 24 rabbeted to mate with the rim of base 12. An opening 25 is provided in the top of dome 12 which is centered therein for the rotational support of spinner 15. As shown more clearly in FIGS. 2 and 4, opening 25 comprises a lower cylindrical section 26 having a relatively smaller diameter which opens into the hollow interior of dome 13 and a relatively larger diameter cylindrical section 27 which opens outward of the dome. Sections 26 and 27 are concentric and are axially aligned with retainer 22 of base 12 in the assembled condition of device 10. A shoulder 28 is formed at the junction of sections 26 and 27 of opening 25.

Impeller 14 comprises four vanes 31 arranged about an axial positioned center post 32. Vanes 31 extend radially outwardly from and are uniformly positioned about post 32 at ninety degree intervals so that opposite vanes are parallelly arranged and adjacent vanes are perpendicularly positioned to each other. The outer edges 33 of vanes 31 are shaped to conform with the curved inside contour of dome 13, while their lower edges 34 are notched to clear post 21. A positioning pin 35 extends axially downwardly from the center of post 32 into the circular depression 22 in the top of post 21. The top portion of post 32 is pierced along its axis by a cylindrical hole 36.

Spinner 15 comprises a flat disc-shaped vane 37 carried by a cylindrical post 38 that extends radially outwardly from an edge of the vane. A shaft 39 with a diameter considerably smaller than that of post 38 extends axially outwardly from the hole 36 in post 32 and into an aperture or opening 38' in the outer end of post 38. One end of shaft 39 fits tightly in hole 36 and at its other end fits frictionally in hole 38' of post 38 such that if the spinner is pulled off of device 10, shaft 39 will remain in post 32. The spinner may comprise a disc-like member, the opposing sides of which have sets of markings 37' thereon. The individual sets may constitute less than a full representation of a fanciful character, but compliment one another so that when the member is rotated, the set provides a full representation of the character to someone viewing the same from a relatively fixed point thereopposite as disclosed in U.S. Pat. No. 4,252,273.

In the assembly of device 10 shaft 38 of spinner 15 is passed into opening 25 of dome 13 with its opening 38' receiving therein shaft 39 of impeller 14. Shaft 39 fits snugly in hole 38' and is secured therein. The assembled spinner 15, dome 13 and impeller 14 are then positioned over base 12 with pin 35 of impeller 14 inserted into retainer or depression 22 in post 21 with rabbeted mating rims of dome 13 and base 12 pressed together to complete the assembly of device 10.

In preparation for use as a drinking device, drinking straws or straw segments 16 and 17 are then inserted into the ends of bushings 18 and 19, respectively of housing 12. As shown in FIGS. 2 and 3, the inside surfaces of these bushings are slightly tapered with the larger diameter of the taper opening outwardly of the housing. Drinking straws of various diameters may thus be inserted in the bushings where they will be retained by the wedging pressure created by the frictional fit accomplished by their insertion in bushings 18 and 19.

The free end of straw or straw segment 16 is then lowered into a glass of liquid and the user places the end of straw or straw segment 17 in his/her mouth and draws liquid and entrapped air through device 10. The liquid and air flows through straw 16, bushing 18 and into impeller chamber 11 of device 10 formed by base 12 and dome 13. The sharply tapered entry of bushing 18 into base 12 produces a converging stream of fluid 40 and entrapped air which is driven against the surface of impeller vane 31 as shown by the arrows 40 in FIG. 3. The force of the stream of liquid and entrapped air against vane 31 causes impeller 14 to rotate in the direction of arrow 41. As vane 31 then moves past the opening at bushing 19, the fluid and air passes through bushing 19 and straw 17 into the user's mouth.

The convergence of the fluid stream illustrated by arrow 40 results in increased liquid velocity in the region of contact with the impeller vane. The increased velocity enhances the mechanical efficiency of the device, producing higher rotational speeds for the impeller relative to the effort required by the user in drawing liquid from the straw. The relatively small dimensions of the total cavity formed by dome 13 also results in relatively high liquid velocities past the impeller. The close conformance of the outer edges of vanes 31 with the inside surfaces of dome 13 and base 12 effectively limits the diversion of liquid around the edges of the vanes, and the proximity of the bushing entries into the lower flat surface of base 12 minimizes the mass of liquid that is carried as ineffectual dead weight in the housing by the impeller 14. All of these factors contribute further to the mechanical efficiency of the device.

As shown in FIG. 2, the base of post 38 of spinner 15 rests upon the shoulder 28 formed at the junction of sections 26 and 27 of opening 25. The outer cylindrical surface of post 38 is slightly smaller in diameter than section 27, and shaft 39 is slightly smaller than section 26. With the weight of spinner 15 thus supported by post 38 resting upon shoulder 28, there is little opportunity for the passage of air through the intervening space between post 38, shaft 39 and opening 25. To assure that the weight of spinner 15 is carried by shoulder 28 and thereby to insure an effective air seal at opening 25, the hole that constitutes retainer 22 in base 12 is made sufficiently deep to guarantee that pin 35 cannot bottom out when inserted therein, in which case retainer 22 provides only horizontal control and positioning at the base of impeller 14. Because the spinner 15 is positioned on top of the clear dome 13, gravity holds the larger diameter shaft 38 on the smaller diameter shaft 39 of spinner 15 inside of dome 13 thus sealing the possible inlet for air seepage into the hollow interior of the dome. The virtual elimination of entrained air in this manner also contributes very significantly to the mechanical efficiency of the device.

Because device 10 is intended for use primarily by children, safety is a consideration of utmost importance. For this reason, care has been taken, first of all, to insure that there are no individual parts that are small enough to become entrained in the liquid and drawn into the user's mouth. The individual parts are molded from a plastic material that is sufficiently flexible and resilient to prevent fracture under any conceivable stress that might be sustained under conditions of abuse by the user. The spinner, for example, is in one piece, including only post 38. Shaft 39 is firmly secured to impeller 14 inside of dome 13. The diameter of post 38 is large enough to insure that it cannot be broken when subjected to severe abuse by the users during use. The depth of section 27 of opening 25 assures mechanical support of post 38 by section 27 so that the smaller diameter shaft 39 is relieved of excessive lateral pressure in the event of a lateral force against vane 37.

Further, shaft 39 of impeller 14 is covered by the blister formed by dome 13 thereby concealing the smaller shaft 38 for safety purposes. It should be noted that safety spinner 15 may be removed and substituted with a different spinner, logo design, etc. at will.

In order to fasten the device to a cup or glass, a hanger 41 may be provided on the outside of base 12 as shown in FIGS. 1 and 5. It should be noted that not only does hanger 41 provide a means for a "hands off" drinking device, it also serves the purpose of keeping the drinking device in a vertical position to assure the sealing of shaft 38 in opening 25 of dome 13. Further, this arrangement assures that bushing 18 is connected to the drink.

Figure 6:
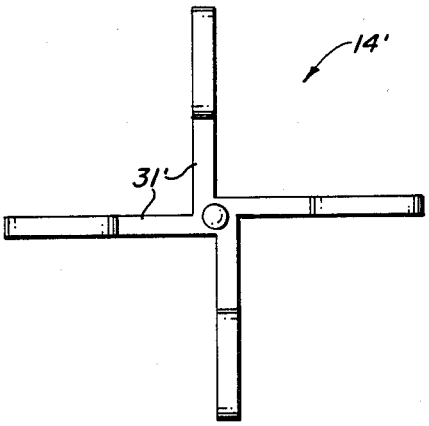
FIG. 6 is a bottom view of a modification of the impeller shown in FIG. 5 taken along the line 6—6.
Figure 7:
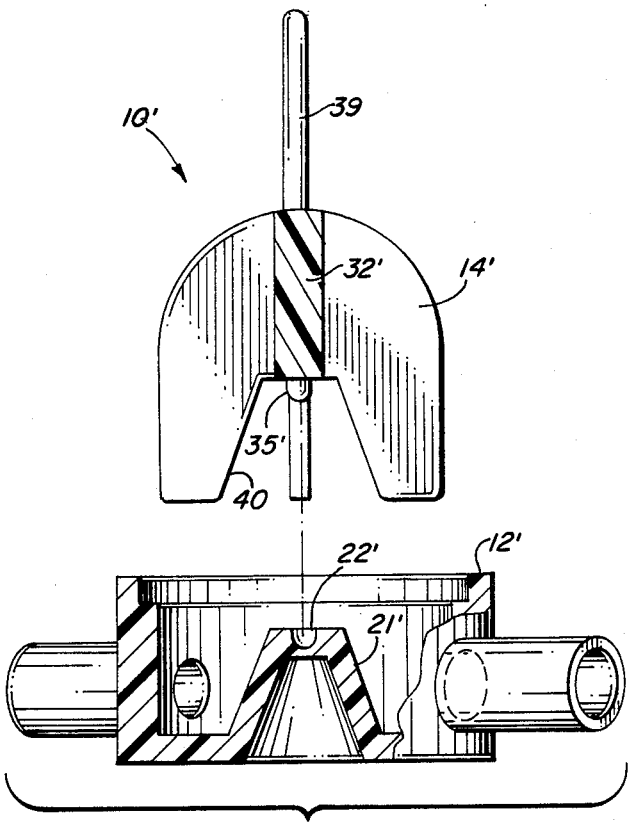
FIG. 7 is a partially cutaway side view of a second embodiment of the invention employing a modified impeller and impeller chamber design.

FIGS. 6 and 7 show modified versions of the impeller and base members shown in FIGS. 1–5 with common parts shown in FIGS. 1–5 identified in FIGS. 6 and 7 by simpler reference characters primed. Base 12' of the modified version 10' has a tapered post 21' which is provided with a retainer or opening 22'. The tapered post 21' further reduces the total fluid volume of the device and forces liquid flow toward the outer surfaces of impeller 14' where it is more effective in producing rotation. Impeller 14' has a conforming tapered indentation 40 to provide clearance for the tapered post 21'.

As shown in FIG. 6, opposite vanes 31' are offset to provide an enlarged cross-section at the center as needed to receive post 39 of the spinner.

An improved amusement drinking device is thus provided in accordance with the stated objects of the invention and although but a single embodiment of the invention has been illustrated and described, it will be apparent to those skilled in the art that various changes and modifications may be made therein without departing from the spirit of the invention or from the scope of the appended claims.

What is claimed is:

1. A drinking device comprising:

a hand supportable siphoning device defining a passage for the flow of liquid between a body of liquid and the mouth of the user, said device comprising a shallow cup-shaped base and a dome detachably connected thereto, said dome having an aperture extending therethrough at its apex, said aperture extending through said dome comprising a cylindrical configuration having two portions, one of said portions extending outwardly of said dome having a larger diameter than the second of said portions which opens into the interior of said dome, said base having axially aligned inlet and outlet ports, a post mounted in said base the longitudinal axis of which extends laterally of said inlet and outlet ports, an impeller journalled on said post within said dome and having a shaft extending longitudinally thereof into said aperture in said dome, a rotor mounted on the portion of said shaft projecting outwardly of the interior of said dome and into said aperture for the amusement of the user, said rotor having a cylindrical post extending outwardly of the periphery of said rotor with its exposed end having an opening along its length for receiving therein said shaft of said impeller, said shaft of said impeller when extending into said opening in said cylindrical post seating said exposed end of said cylindrical post in said first portion of said aperture to substantially seal said aperture against cavitation of air from the atmosphere during use, a pair of bushings mounted one within each of said inlet and outlet ports for each receiving a straw, said bushings having passageways extending therethrough which taper inwardly toward said inlet and outlet ports in said base for snugly receiving straws of various diameters, said impeller and said rotor attached thereto being caused to undergo rotation in response to the flow of liquid through said base when straws inserted in said bushings are placed one within a body of liquid and one within the mouth of a user for purposes of enabling the user to suck through said one of said straws the liquid from the body of liquid through the base of the device.

2. The drinking device set forth in claim 1 wherein:

the axially aligned axis of said inlet and outlet ports through said base is spaced from the longitudinal axis of said post.

3. The drinking device set forth in claim 1 wherein:

the cross-sectional area of the bushing mounted in the inlet port is smaller than the cross-sectional area of the bushing in the outlet port.

4. The drinking device set forth in claim 1 wherein:

said dome is formed of a transparent material.

5. The drinking device set forth in claim 1 wherein:

said rotor comprises a disc.

6. The drinking device set forth in claim 1 in further combination with:

a clip fastened to the outside of said base for gripping the container holding the liquid.

7. The drinking device set forth in claim 1 wherein:

said post is provided with a cylindrical depression in its exposed end, and said impeller is journalled in said cylindrical depression.

8. The drinking device set forth in claim 1 wherein:

said post is provided with a cylindrical depression in its exposed end, said impeller is provided with a pin for extending part way into said depression for journalling said impeller on said post.

9. The drinking device set forth in claim 1 wherein:

the diameter of said cylindrical post of said rotor is larger than the diameter of said shaft of said impeller.

10. The drinking device set forth in claim 1 wherein:

the rotor comprises a disc-like member, the opposing sides of which have sets of markings thereon.

* * * * *